US005967047A

United States Patent [19]

Kühn et al.

[11] Patent Number: 5,967,047

[45] Date of Patent: Oct. 19, 1999

[54] THERMAL PROCESS FOR APPLYING HYDROPHILIC LAYERS TO HYDROPHOBIC SUBSTRATES FOR OFFSET PRINTING PLATES

[75] Inventors: Heinrich Kühn, Brechen; Dieter Jaculi, Bad Homburg; Engelbert Pliefke, Wiesbaden; Ulrich Bos, Hochheim; Werner Frass, Wiesbaden, all of Germany

[73] Assignee: Agfa-Gevaert AG, Leverkusen, Germany

[21] Appl. No.: 08/666,292

[22] PCT Filed: Dec. 19, 1994

[86] PCT No.: PCT/EP94/04218

§ 371 Date: Sep. 20, 1996

§ 102(e) Date: Sep. 20, 1996

[87] PCT Pub. No.: WO95/18019

PCT Pub. Date: Jul. 6, 1995

[30] Foreign Application Priority Data

Dec. 27, 1993 [DE] Germany ..... 43 44 692
Jan. 15, 1994 [DE] Germany ..... 44 01 059

[51] Int. Cl.[6] ..... B41N 1/08; B41N 3/04; C23C 4/10

[52] U.S. Cl. ..... 101/454; 101/458; 101/459; 101/465; 427/453

[58] Field of Search ..... 101/453, 454, 101/455–457, 458, 459, 460, 463.1, 465, 467; 427/453–456

[56] References Cited

U.S. PATENT DOCUMENTS

| | | | |
|---|---|---|---|
| 4,301,730 | 11/1981 | Heurich et al. | 101/348 |
| 4,526,839 | 7/1985 | Herman et al. | 101/458 |
| 4,596,189 | 6/1986 | Halpern et al. | 101/458 |
| 5,382,964 | 1/1995 | Schneider | 101/463.1 |
| 5,432,046 | 7/1995 | Wanat et al. | 101/454 |
| 5,454,318 | 10/1995 | Hirt et al. | 101/465 |

FOREIGN PATENT DOCUMENTS

| | | | |
|---|---|---|---|
| 0115678 | 8/1984 | European Pat. Off. . | |
| 0118740 | 9/1984 | European Pat. Off. . | |
| 0127091 | 12/1984 | European Pat. Off. . | |
| 0213371 | 3/1987 | European Pat. Off. . | |
| 0412219 | 2/1991 | European Pat. Off. . | |
| 2064354 | 2/1979 | Germany . | |
| 3512176 | 10/1986 | Germany | 101/459 |
| 2906376 | 3/1988 | Germany . | |
| WO 8102547 | 9/1981 | WIPO . | |

*Primary Examiner*—Stephen R. Funk
*Attorney, Agent, or Firm*—Frommer Lawrence & Haug LLP

[57] ABSTRACT

This invention relates to a process for preparing printing plates which are used in offset printing. The process produces a plate which comprises a substrate film in which a thin durable hydrophilic layer has been applied thereto. In the process, the substrate film is first microroughened by pressure blasting so that the surface roughness, $R_A$, is in the range 0.3 to 1.5 $\mu$m. Subsequently, a durable, firmly adhering hydrophilic layer is applied to substrate by plasma-spraying an oxide powder with a particle size of 1 to 40 $\mu$m onto the substrate. This process produces a plate whose surface is not greasy or grainy.

26 Claims, 1 Drawing Sheet

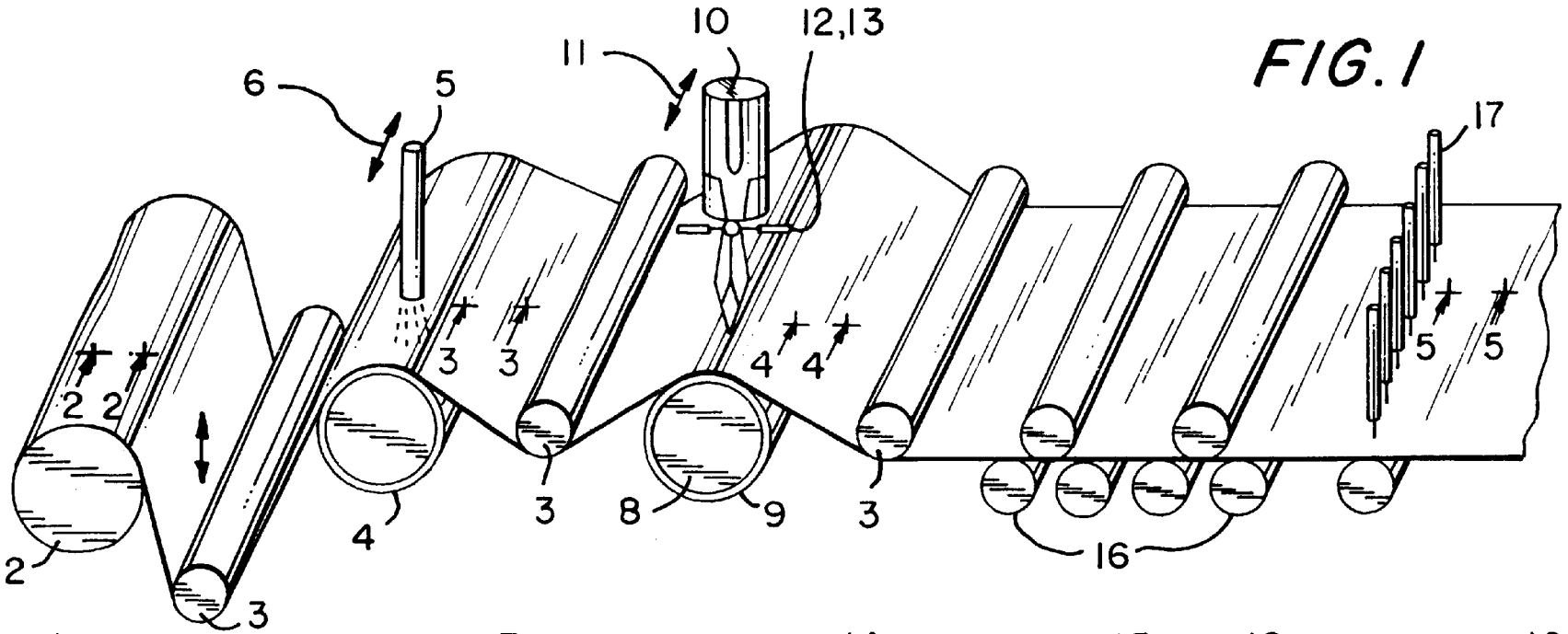
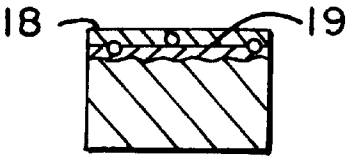
FIG. 5
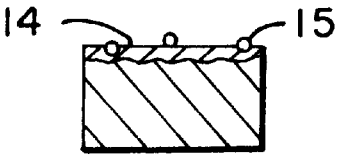
FIG. 4
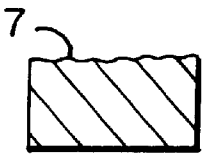
FIG. 3
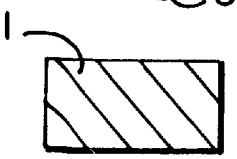
FIG. 2

THERMAL PROCESS FOR APPLYING HYDROPHILIC LAYERS TO HYDROPHOBIC SUBSTRATES FOR OFFSET PRINTING PLATES

RELATED APPLICATIONS

This application is filed pursuant to 35 U.S.C. § 371 and is the U.S. national phase application of International Application No. PCT/EP94/04218, filed on Dec. 19, 1994. The application claims priority to German application Nos. P 43 44 692.2 and P 44 01 059.1 filed Dec. 27, 1993 and Jan. 15, 1994 respectively.

The invention relates to a thermal process for applying hydrophilic ceramic layers to substrates for printing plates. Owing to the achievable surface topography, this hydrophilized substrate is particularly suitable for coating with photosensitive layers which can be converted into printing plates which, after exposure to light and development, give printing plates which have uniform topography, permit long print runs and ensure good transport of damping solutions.

BACKGROUND OF THE INVENTION

1. Field of the Invention

The most frequently used printing plates for the offset printing process usually consist of a substrate on which a photosensitive layer is firmly applied. This layer is exposed to light, after which the nonimage part must be removed completely from the surface. By means of the hydrophobic layer which remains behind (image part), ink can be applied to the product to be printed, which however is ensured only when water is present in the region of the nonimage parts. The wettability with water (hydrophilic property) in the region of the nonimage parts is of decisive importance for a high-quality printed image. It is known that alumina has such properties.

2. Description of the Related Art

It is therefore obvious to use aluminum substrates, to roughen the latter in order to improve anchoring of the printed image and to oxidize the surfaces. Chemical or electrochemical processes, also in combination with mechanical processes, for roughening pure aluminum have been disclosed, for example, in DE-A-34 13 899.

The multistage processes require a uniform aluminum composition at the substrate surface in order to ensure that, in a controlled chemical process, a uniform surface topography free of grains is obtained. The disposal of the baths and of the resulting solid are to be regarded as negative factors.

German Auslegeschrift 1,300,579 has disclosed a process in which a plasma is generated by means of an electric arc between a heat-resistant electrode and a metallic substrate in an inert gas mantle, with the aid of which plasma printing plates are roughened with small amounts of waste, and the surface can be modified by adding materials in such a way that it has improved hydrophilic properties. However, this process is difficult to realize in practice since it is very dependent on the intensities of the transmitted arcs, which are determined by a plurality of factors.

German Auslegeschrift 2,348,717 has disclosed a further process for applying damping solution-conveying layers to printing plates for the offset printing process. Layers of sparingly soluble or insoluble carbonates, silicates or quartz are provided, said layers being applied to roughened substrates by the plasma-spraying process method and then being ground to produce the suitable roughness. The image area is obtained by partially removing the coating. However, this process is very expensive owing to the machining and the etching process for removal of the layer.

SUMMARY OF THE INVENTION

It was the object of the present invention to provide a thermal coating process for rendering surfaces hydrophilic, in which not only aluminum substrates but also other metals, such as steels and other nonferrous metals and alloys, or even plastics can be reliably treated and can be firmly coated. The residues are to be reduced to a minimum and should be obtained in such a form that they can be readily reused.

The object is achieved, according to the invention, by a process of the generic type which is stated at the outset and whose defining features comprise producing a surface roughness $R_a$ in the range from 0.3 to 1.5 $\mu$m on the surface of the substrate film by mechanical microroughening in a first treatment step and then providing the substrate film with a durably firmly adhering hydrophilic coating by thermal-spraying processing of pulverulent oxides and/or oxidic mixtures and compounds having a mean particle size in the range from −40 to +1 $\mu$m.

For the purposes of the present invention, stated particle sizes of the type from −40 to +1 $\mu$m mean that no particles having a particle size greater than 40 $\mu$m and no particles having a particle size less than 1 $\mu$m are present in the powder having corresponding stated particle sizes.

The hydrophilic layer applied according to the invention performs a plurality of functions which have a positive effect during coating with photosensitive resins and during use as offset printing plates.

For people skilled in the art, it was surprising that particularly thin, flexible and abrasion-resistant coatings can be applied with small layer thickness tolerances without machining, so as to give a uniform surface as measured by the "Kernrauchtiefe" following DIN 4776, which is in particular such that randomly well distributed point-like deepenings result and are formed in such a way that the photosensitive resin layer applied thereon can be firmly anchored for producing the image part. A further advantageous effect evident during exposure to light was achieved by virtue of the fact that it is possible to achieve randomly well distributed peaks from the grain peak-to-valley height. Further advantages of this process are that a very wide range of substrates, such as plastics or metals, can be used with the same machine arrangement, and coating materials which differ in their chemical composition can be tailored to the particular application. The resulting wastes can be collected separately according to type and in dry form and can be returned to the material cycle.

BRIEF DESCRIPTION OF THE DRAWING

FIG. 1 is a schematic view of the process which depicts the process sequence of the invention with the surface magnified.

FIG. 2 is a cross-sectional sectional view taken along lines 2—2 of FIG. 1.

FIG. 3 is a cross-sectional view taken along lines 3—3 of FIG. 1.

FIG. 4 is a cross-sectional view taken along lines 4—4 of FIG. 1.

FIG. 5 is a cross-sectional view taken along lines 5—5 of FIG. 1.

DESCRIPTION OF THE PREFERRED EMBODIMENTS

The following description of preferred embodiments of the invention serves, in conjunction with the drawing, for more detailed illustration.

FIG. 1 schematically shows a process sequence with the magnified surface states.

A metal or plastic film 1 as a substrate for offset printing plates is unwound continuously from a roll 2 at constant strip speed, and the substrate should preferably have a thickness in the range from 100 to 500 μm, particularly preferably from 120 to 350 μm, and a thickness tolerance of ±2% with a pit-free and grain-free surface which is free from coarse organic or mineral residues. Aluminum and its alloys having the preferred composition or stainless steels or refined steels may be provided as metallic materials. The substrate film can be a metal foil comprising aluminum and an alloy thereof, stainless steel or refined steel or a metal hybrid. The substrate film can also be heat-fixed plastics comprising thermoplastic materials. Such materials include, for example, polyvinylchloride, polyesters, such as polyethylene terephthalate or polybutylene terephthalate, polyamide, polyphenyl sulfide or polypropylene. Other metallic materials which withstand the corrosion by the damping solution and which fulfill the mechanical properties may also be used.

Thermoplastic polyesters can preferably be used as plastics, polyethylene terephthalate-containing homo- and copolymers and mixtures thereof with other polyesters or polyamides being particularly suitable. The plastics may furthermore contain fillers in an amount of up to 5% by weight, inorganic fillers, such as clay, titanium dioxide and/or alumina, being particularly suitable. The plastic preferably contains at least 1.5% by weight of fillers.

The substrate 1 is fed via a freely rotating, vertically guided movable roll 3 for speed compensation and for ensuring as large a possible angle of wrap for the treatment roll 4 arranged thereafter. On the treatment roll 4, the substrate 1 resting against said roll is mechanically roughened according to the invention in a first operation so that a microrough surface results, without the substrate being damaged by warping. Sandblasting processes for rust removal, for removal of paint coats or for strengthening surfaces are already known, but it was surprising that thin films can be provided with particularly uniform microrough surface topographies with little warping.

A "pressure-blasting process" in which the blasting pressure is in the range from 0.5 to 2; bar, preferably from 0.6 to 1.5 bar, is advantageously used according to the invention. The distance between the nozzle and the substrate 1 is in the range from 50 to 150 mm, preferably from 50 to 80 mm. Particularly suitable blasting materials are sharp-edged blasting materials, in particular mineral blasting materials, such as $Al_2O_3$ or corundum, having a particle size in the range from 10 to 100 μm, preferably from 20 to 50 μm. The amount of blasting material is 500 to 1,000 g/m$^2$ of substrate, said amount being metered at a constant rate. The metering is advantageously carried out by rotating mechanical metering apparatuses. The blasting apparatus 5, which may also comprise a plurality of nozzles, is moved parallel to the longitudinal axis 6 of the treatment roll 4 at a speed of 1,000 to 2,000 mm/s. After the blasting process, the surface of the substrate is freed from dusts.

A hard-wearing body with low mass and a flexible rubber covering can be provided as roll 3.

After the roughening treatment according to the invention, the substrate strip 1 has a microrough surface 7 with a roughness $R_a$ of 0.5 to 1.5 μm, preferably 0.2 to 1.0 μm, and can be fed continuously or in synchronized steps to the coating station, the plasma-spraying processing.

The thermal-spraying process, plasma-spraying processing using a plasma burner 10 in a natural ambient atmosphere with a nontransmitted arc according to DIN 32530, is known as a technology for applying thick layers. Oxidic layers, on rotationally symmetrical parts, or coating of surfaces or partial surfaces by means of robots by repeated painting, in thicknesses of 50 to 500 μm, are part of the prior art.

The continuous coating of strip-like thin films with oxidic hydrophilic layers by plasma-spraying processing in thicknesses of <20 μm for use as printing plates is described in WO 94/5507, which however gives the person skilled in the art no indication of the microroughening according to the invention.

For coating by plasma-spraying processing, the substrate 1, which may be 500 to 2,000 mm wide, is moved continuously or cyclically in accordance with the spray jet width, which may be 6 to 12 mm at the zenith, by means of a driven treatment roll 8 at a speed in the range from 5 to 50 mm/s, in contact with said treatment roll, under the hot gas jet of the plasma burner 10.

The use of a plurality of plasma jet burners is particularly advantageous and increases the coating speed several fold, according to the number of burners. For example, in the case of the particularly advantageous use of 10 plasma jet burners, an area in the range from 300 to 1,000 m$^2$/h can thus be coated.

The roll body of the treatment roll 8, which may comprise steel, aluminum or other metal alloys, furthermore has the task of absorbing and removing the heat from the thermal process, to which the substrate for printing plates is inevitably exposed. Additional cooling of the roll body with heat-removing flow media results in a trouble-free process, it being necessary to ensure that the temperature does not fall below the dew point.

In the hot gas jet of the plasma burner, which is moved parallel to the longitudinal axis 11 of the treatment roll 8 over the substrate 1 at a speed of 1,000 to 2,000 mm/s uniformly, in the form of waves or in an oscillating manner, ceramic powder is added by a metering apparatus 12, 13.

According to the invention, layers having a thickness of 5 to 20 μm and having a layer thickness tolerance of ±5% can thus be applied by plasma-spraying processing. The layers have an adhesion which corresponds to the "film test" as usually employed in electroplating. In this test, self-adhesive strips are pressed against the coated surface and then peeled off again abruptly at right angles to the plane of the coating. The coating material must not remain adhering to the adhesive layer. The layers cannot be removed as a result of flaking off when the substrate 1 is bent to an angle of 90°.

The plasma-forming hot gases used may be argon and nitrogen. Gas mixtures, such as argon/nitrogen, nitrogen/hydrogen or, particularly advantageous, argon/hydrogen, are advantageously used. The electrical power introduced is advantageously from 20 to 50 kW, particularly advantageously 25 to 35 kW.

According to the invention, a very fine powder having a mean particle size of '20 μm is used for producing a layer having a roughness $R_a$ of 1 to 2 μm. Powders having a mean particle size of 5 to 12 μm could particularly advantageously be used. A second powder fraction having a particle size of 20 to 40 μm, which is expediently added separately, makes it possible to produce, out of the basic roughness 14, individual peaks 15 which are randomly uniformly distributed over the surface and whose amount is controllable. In this layer combination, the particles may have different chemical compositions, such as, for example, basic layer $Al_2O_3$–peaks $Al_2O_3$+3% of $TiO_2$.

In order to obtain a hydrophilic hard-wearing layer, it is possible preferably to use aluminas and mixtures or compounds with other oxides, which, according to the invention, give a light absorption factor of 50 to 70% at the layer surface.

Surprisingly, it was also possible to produce in the plasma flame oxidic mixtures or compounds of hydrophilic layer properties from aluminum, aluminum alloys, such as, for example, AlSi, AlMg or Al-Si-Fe, and pelletized or sintered mixtures having these compositions by oxidation of fine powders having the preferred particle sizes of <20 μm.

According to the invention, it is possible to use pulverulent oxides of the type described as such or alternatively pulverulent metals which oxidize in the plasma jet, or a combination thereof.

The layer combination comprising substrate and thermally applied hydrophilic ceramic layer has different hydrophilic properties and greater resistance to wear compared with the oxide mixtures produced in the plasma gas jet and obtained from metals.

It is also possible to use a second oxide powder that has a chemical composition which differs from that of the first oxide powder and has a particle size of 1 to 20 μm. Powders wherein the second oxide powder is zirconium oxide or magnesium oxide are especially preferred.

The oxide powders employed in the inventive process may comprise mechanical mixtures of metals and may be pelletized or sintered mixtures. Additionally, the oxide powders may be ceramics or agglomerated particles of said mechanical mixtures or pelletized or sintered mixtures of oxides surrounded by metals.

For the purposes of the invention, it is also possible to start from a ceramic powder surrounded by aluminum or an aluminum alloy or from agglomerated particles comprising metal and ceramic, and to coat a substrate for offset printing plates therewith.

After the plasma-spraying processing process, cleaning 16 by blowing off and sucking off the nonadhering particles is expediently carried out. These particles can likewise be recycled to the material circulation, analogously to the sand-blasting process, together with the dusts obtained in the plasma-spraying processing process. The cleaned strips are then coated in a coating station 17 on the hydrophilized surface 19 with a photosensitive layer 18. The coated strips are then dried and, if necessary, subjected to heating processes.

The preferred plasma-forming gases used in the thermal spraying process, are argon, nitrogen, argon/nitrogen, nitrogen/hydrogen or argon/hydrogen. For high-speed flame spraying, the preferred combustion gases are hydrogen, acetylene, propane, propylene and oxygen.

After this process, the printing plates can be cut to their final size from the strip-like material. The actual formating to give printing plates is carried out in the printing works by known methods.

EXAMPLES

Example 1

A rolled aluminum foil strip, material No. 3.0205, having a thickness of 300 μm and a width of 1600 mm was subjected to a sand-blasting process in a first operation. Two blasting nozzles having a diameter of 8 mm were moved at a speed of 1.5 mm/s above the foil strip at a distance of 60 mm, parallel to the longitudinal axis of the sand blasting roll. The sand blasting roll itself moved at a speed of 25 mm/s. The blasting material used was a fused and crushed sharp-edged alumina containing 3% by weight of titanium oxide, which had a mean particle size of 20 to 45 μm. The blasting material was metered by means of a rotating disk having a metering channel, so that the foil strip was blasted at 700 $g/m^2$ of blasting material. The amount of compressed air was 250 $m^3/h$ at a pressure of 1.2 bar. The blasting material used was conveyed into a dust classification unit, where dusts having a particle diameter of <3 μm were removed from the blasting material. The dust-free blasting material was then reused. The total consumption of blasting material could be reduced to an amount of 35 $g/m^2$ by this measure.

After blasting, the surface of the foil strip was cleaned by blowing off with dry compressed air and then with a rapidly evaporating commercial solvent in a spraying process. The metal sheet had a roughness $R_a$ of 0.92 μm, measured according to DIN 4768.

The cleaned foil strip was then coated with a powder combination comprising 99.5% of alumina, 97:3 of aluminum/titanium oxide and partly oxidized aluminum after the plasma-spraying process. The particle size of the alumina was −12 μm+5 μm (designated powder A) and the alumina containing 3% of titanium oxide had a particle size of −40 μm+20 μm (designated powder B). A mixture comprising 95% of powder A and 5% of powder B was produced from these oxides (designated powder C). The particle size of the aluminum was −20 μm+5 μm (designated powder D). The hot gas jet (plasma flame) was produced using a gas mixture comprising 8% of hydrogen and 92% of argon, and the electrical power was 28 kW. Powders C and D were injected separately into the plasma flame. The plasma flame was moved at a speed of 1800 mm/sec above the foil strip, at a distance of 70 mm. The foil strip was moved discontinuously by a water-cooled roll in steps of 12 mm, which are triggered by the transport unit of the plasma flame. The water temperature of the roll was +10° C., the angle of wrap was 180° and the contact force of the foil was 10 N. The layer thus produced had a thickness of 10 μm and a surface roughness $R_a$ of 1.2 to 1.5 μm (DIN 4768). The adhesion of the layer was tested using a self-adhesive film, and very good adhesion was found. The hydrophilized foil strip was then coated with a photosensitive layer, exposed to light and developed to give a printing plate. In a printing test, the printing plate obtained was of good quality and has the following features:

1.) The 6 μm lines were reproduced in light form in the UGRA test.

2.) The idling characteristics as an indication of good damping solution transport showed no troublesome behavior.

3.) Compared with a commercial correcting agent (KP 273), no color differences occur after the correction (=freedom from color fog).

4.) The print run was 130,000 prints.

5.) In the case of a plate cured for 5 minutes at 230° C. after development, the print run was 500,000 prints.

Example 2

An aluminum foil strip as in Example 1 was moved using the same machine arrangement as in Example 1. The hydrophilic layer was applied by the high-speed flame spraying method. Powders C and D, as from Example 1, were used in the burner. Powder C was injected directly into the center of the flame, in which the combustion gas used comprises acetylene in an amount of 4,400 l/h and oxygen in an amount of 6,200 l/h. Powder D was injected into the flame upstream of the burner. 5 burners were mounted on the traversing unit, so that a width of 75 mm could be coated simultaneously.

The burner distance was 200 mm. The layer produced in this manner had a thickness of 10 to 12 μm and a roughness $R_a$ of 1.2 to 1.5 μm. Testing of the adhesive strength of the applied layer using a self-adhesive strip indicated very good adhesion. Processing to give a printing plate was carried out analogously to Example 1.

Example 3

A biaxially oriented and heat-fixed foil strip comprising polyethylene terephthalate and having a thickness of 300 μm and a width of 1600 mm was subjected to a microroughening process as stated in Example 1. The blasted surface was cleaned by blowing off with dry compressed air, but without organic solvents, and had a non-furrowed, fine-particled, microrough surface topography with a roughness $R_a$ of 0.8 to 1.2 μm, measured according to DIN 4768.

The blasted foil strip was then transported to the plasma-spraying processing station. There, it was pressed closely against a roll cooled with water to a temperature +10° C., under a force of 10 N. The roll rotated at a uniform speed of 25 mm/s under two plasma burners which themselves were moved back and forth horizontally, i.e. parallel to the longitudinal axis of the roll, at a speed of 2,000 mm/s.

The distance between the burners and the foil strip was 100 mm. In order to operate the plasma flame, a gas mixture of 10% by volume of hydrogen and 90% by volume of argon was used, and the electrical power was 28 kW. A mixture of powder D and powder C (designation as in Example 1) was introduced in a mixing ratio of 30:70 into the plasma flame from two separate metering systems. The total amount of powder was adjusted so that, at a powder efficiency of 90%, a uniform layer having a thickness of 5 μm is formed. The fluctuation in the thickness of the layer thus produced was ±5%.

The surface roughness $R_a$ of the layer was 0.95 μm, measured according to DIN 4768. The determination of the color location gave an L value of 75, measured using the Cielab system according to DIN 5033. The number of peaks in the range between 3 and 10 μm was 1,000 $m^2$, determined by means of image analysis. The adhesion of the layer was tested using a self-adhesive film as in Example 1 and showed that it was not possible to peel off parts of the layer by means of the self-adhesive film at right angles to the plane of the layer and starting from the outer edge, i.e. very good adhesion. The hydrophilized foil strip was then coated with a positive diazo copying layer, exposed to light and developed to give a printing plate. In a printing test, the printing plate obtained was of high quality and has the following features:

1.) The 6 μm lines were reproduced in light form in the UGRA test.

2.) The idling characteristics as an indication of good damping solution transport showed no troublesome behavior.

3.) Compared with a commercial correcting agent (KP 273), no color differences occur after the correction (=freedom from color fog).

4.) The print run was 120,000 prints.

5.) In the case of a plate cured for 5 minutes at 230° C. after development, the print run was 450,000 prints.

Comparative Example

An aluminum foil strip as in Example 1 was coated with a conventional aluminum powder having a particle size of −80+40 μm and a conventional alumina powder having a particle size of −53+10 μm by the plasma-spraying method. The two particle sizes were mixed in a weight ratio of 1:1 and injected into the plasma flame. The usual parameters as shown in data sheets of manufacturers of plants for the application of oxide coatings are used. It is advisable to employ an argon/hydrogen mixture comprising 75% by volume of argon and 25% by volume of hydrogen, at an electrical power of 37 kW. The layer had a roughness $R_a$ of 4 μm (DIN 4768) and a nonuniform composition, since the readily melting aluminum adhered to the injector and became detached as molten material in large wafers and was deposited as peak-like protuberances on the foil strip. In the case of the printing plate produced therefrom as in Example 1, only the 25 μm lines were reproduced in light form in the UGRA test. Furthermore, point-like image parts remained adhering in the region of the nonimage parts, owing to the excessively high roughness. The printing plates thus produced do not meet the quality standards of offset printing works.

We claim:

1. A process for the production of a printing plate comprising a substrate film having a hydrophilic layer wherein said hydrophilic layer is formed on the substrate film by a thermal spraying process, said process comprising the steps of microroughening the substrate film by pressure blasting with a material so that the surface roughness, $R_A$, is in the range of 0.3 to 1.5 μm; and applying a durable, firmly adhering hydrophilic coat by spraying a very fine powder having a mean particle size of <20 comprising an oxide, a multiple oxide or a mixture thereof.

2. The process according to claim 1 wherein the powder is sprayed by a plasma spraying process using a hot gas jet.

3. The process according to claim 2 wherein, after the microroughening step, the substrate film is fed from a roll via a freely rotating, vertically guided roll to a downstream treatment roll and, while resting closely against the downstream treatment roll, is moved under the hot gas jet of a spraying means, the spraying means being moved parallel to the longitudinal axis of the treatment roll, in a straight line or in a wavy manner, above the substrate film.

4. The process according to claim 3, wherein the spraying means comprises at least two spray burners.

5. The process according to claim 3, wherein heat-removing flow media flow through the treatment roll.

6. The process according to claim 2 wherein the powder is comprised of an oxide and an additional fine metal powder and the powder is then reacted in a plasma jet to yield products having hydrophilic properties.

7. The process according to claim 6, wherein the additional fine metal powder is aluminum, an aluminum alloy or a mixture of aluminum and another metal.

8. The process according to claim 2, wherein the gases used in the plasma spraying process are argon, nitrogen, argon/nitrogen, nitrogen/hydrogen or argon/hydrogen.

9. The process according to claim 1, wherein the material used in the pressure blasting step is a sharp-edged mineral with a particle size in the range of 10 to 100 μm and the pressure is in the range of 0.5 to 2 bar.

10. The process according to claim 1, wherein the substrate film is a metal foil which has a thickness in the range from 100 to 500 μm, and the surface of said foil is pit-free and grain-free and is free from coarse organic or mineral residues.

11. The process according to claim 10, wherein the thickness of the metal foil is in the range of 120 to 350 μm.

12. The process according to claim 10, wherein the metal foil comprises aluminum or an alloy thereof, stainless steel, refined steel or a metal hybrid.

13. The process according to claim 1, wherein the substrate film is a biaxially oriented and heat-fixed film comprising a thermoplastic material which has a thickness of 100 to 500 $\mu$m.

14. The process according to claim 13 wherein the thermoplastic material is polyvinyl chloride, a polyester, a polyamide, polyphenylene sulfide or polypropylene.

15. The process according to claim 14, wherein the polyester is polyethylene terephthalate or polybutylene terephthalate.

16. The process according to claim 1, wherein the powder is alumina, or a multiple oxide containing alumina, or a mixture of alumina and a multiple oxide containing alumina.

17. The process according to claim 16, wherein the powder has a particle size of 1 to 20 $\mu$m.

18. The process according to claim 17, wherein a powder is introduced separately into a plasma jet.

19. The process according to claim 16, wherein the powder is a mixture of an oxide powder having a particle size of 1 to 20 with $\mu$m and a second oxide powder having a particle size of 20 to 40 $\mu$m.

20. The process according to claim 19, wherein the second oxide powder has a chemical composition which differs from that of the first oxide powder.

21. The process according to claim 20, wherein the second oxide powder is zirconium oxide or magnesium oxide.

22. The process according to claim 1, wherein the powder is sprayed by a high-speed flame spraying process which employs a combustion gas and the combustion gas is hydrogen, acetylene, propane, propylene or oxygen.

23. The process according to claim 1, wherein the powder is a mechanical mixture, pelletized or sintered mixture of an oxide and a metal or agglomerated particles of an oxide surrounded by a metal.

24. The process according to claim 1, where the powder additionally comprise a ceramic.

25. The method according to claim 24, wherein the printing plate is a blank printing plate.

26. In a method for offset printing the improvement, which comprises employing a printing plate comprising a substrate film having a hydrophilic layer formed on the substrate film, obtained by a process comprising the steps of microroughening the substrate film by pressure blasting with a material so that the surface roughness, $R_A$, is in the range of 0.3 to 1.5 $\mu$m; and applying a durable, firmly adhering hydrophilic coat by thermally spraying a very fine powder having a mean particle size of <20 $\mu$m comprising an oxide, a multiple oxide or a mixture thereof.

* * * * *